US005742117A

United States Patent [19]

Spindt et al.

[11] Patent Number: 5,742,117

[45] Date of Patent: *Apr. 21, 1998

[54] METALLIZED HIGH VOLTAGE SPACERS

[75] Inventors: Christopher J. Spindt, Menlo Park; David L. Morris, San Jose, both of Calif.

[73] Assignee: Candescent Technologies Corporation

[ * ] Notice: The term of this patent shall not extend beyond the expiration date of Pat. No. 5,532,548.

[21] Appl. No.: 317,299

[22] Filed: Oct. 3, 1994

Related U.S. Application Data

[63] Continuation-in-part of Ser. No. 188,857, Jan. 31, 1994, abandoned, which is a continuation-in-part of Ser. No. 12,542, Feb. 1, 1993, Pat. No. 5,589,731, which is a continuation-in-part of Ser. No. 867,044, Apr. 10, 1992, Pat. No. 5,424,605.

[51] Int. Cl.[6] ..... H01J 19/44

[52] U.S. Cl. ..... 313/422; 313/495; 313/292; 313/258

[58] Field of Search ..... 313/422, 495, 313/309, 310, 336, 351, 292, 283, 288, 496, 461, 463, 466

[56] References Cited

U.S. PATENT DOCUMENTS

| | | | |
|---|---|---|---|
| 4,020,381 | 4/1977 | Oess et al. | 313/351 X |
| 4,163,949 | 8/1979 | Shelton | 313/309 X |
| 4,174,523 | 11/1979 | Marlowe et al. | 313/422 X |
| 4,622,492 | 11/1986 | Barten | 313/422 |
| 4,900,981 | 2/1990 | Yamazaki et al. | 313/422 |
| 5,003,219 | 3/1991 | Muragishi et al. | 313/422 X |
| 5,063,327 | 11/1991 | Brodie et al. | 313/495 X |
| 5,083,058 | 1/1992 | Nonomura et al. | 313/422 X |
| 5,116,704 | 5/1992 | Kwon | 313/495 X |
| 5,160,871 | 11/1992 | Tomii et al. | 313/422 X |
| 5,170,100 | 12/1992 | Shichao et al. | 313/422 X |
| 5,227,691 | 7/1993 | Murai et al. | 313/422 |
| 5,229,691 | 7/1993 | Shichao et al. | 313/422 X |
| 5,371,433 | 12/1994 | Horne et al. | 313/292 X |
| 5,448,131 | 9/1995 | Taylor et al. | 313/292 X |

FOREIGN PATENT DOCUMENTS

| | | |
|---|---|---|
| 0 436 997 A1 | 7/1991 | European Pat. Off. . |
| 0 464 938 A1 | 1/1992 | European Pat. Off. . |
| 0 496 450 A1 | 7/1992 | European Pat. Off. . |
| 0 580 244 A1 | 1/1994 | European Pat. Off. . |
| 93/18536 | 9/1993 | WIPO . |

OTHER PUBLICATIONS

Andreadakis et al., "Influence of Barrier Ribs on the Memory Margin of ac Plasma Display Panels", *Proceedings of the SID,* vol. 31, No. 4, pp. 355–360, (1990).

Fujii et al., "A Sandblasting Process for Fabrication of Color PDP Phosphor Screens", *SID 92 Digest,* pp. 728–731, (1992).

Terao et al., "Fabrication of Fine Barrier Ribs for Color Plasma Display Panels by Sandblasting", *SID 92 Digest,* pp. 724–727, (1992).

*Primary Examiner*—Ashok Patel

*Attorney, Agent, or Firm*—Wilson Sonsini Goodrich & Rosati

[57] ABSTRACT

A flat panel apparatus includes a faceplate with a backplate interior side, a backplate with a backplate interior side, and sidewalls positioned between the faceplate and backplate, all in combination forming an enclosed sealed envelope. At least one spacer is positioned in the envelope. The spacer includes a spacer backplate face, with a periphery, and it is positioned adjacent to the backplate interior side. The spacer also includes a spacer faceplate face, with a periphery, and it is positioned adjacent to the faceplate interior side. A first conductive layer, metallization, is applied to substantially cover the entire spacer backplate face to its periphery. A second conductive layer, metallization, is applied to substantially cover the entire spacer faceplate face to its periphery. A plurality of spacers can be positioned in the sealed envelope, and the spacers can be in the form of walls, posts, or wall segments. In place of the conductive layers at the faces, each spacer can include a plurality of electrodes that extend along spacer sidewalls. In this embodiment, the spacer has a sidewall electrode that is positioned sufficiently close to each face surface as to create good ohmic contact between the face surface and the respective faceplate or backplate interior side.

33 Claims, 10 Drawing Sheets

METALLIZED HIGH VOLTAGE SPACERS

CROSS-REFERENCE TO RELATED APPLICATIONS

This application is a continuation-in-part of U.S. patent application Ser. No. 08/188,857 entitled "Structure and Operation of High Voltage Supports" by Spindt et al., filed Jan. 31, 1994, now abandoned, which is a continuation-in-part of U.S. patent application Ser. No. 08/012,542, entitled "Internal Support Structure For Flat Panel Device," by Fahien et al., filed Feb. 1, 1993, now U.S. Pat. No. 5,589,731, which is, in turn, a continuation-in-part of U.S. patent application Ser. No. 08/867,044, now U.S. Pat. No. 5,424,605, entitled "Self Supporting Flat Video Display," by Lovoi, filed Apr. 10, 1992. This application is related to the U.S. patent application entitled "Field Forming Electrodes On High Voltage Spacers", filed by Chris Spindt et al, Ser. No. 08/317,205, filed Oct. 3, 1994, now U.S. Pat. No. 5,532,548.

BACKGROUND OF THE INVENTION

1. Field of the Invention

This invention relates generally to flat panel display devices, and more particularly, to large flat panel display devices that use one or more support structures for internally spacing the faceplate and the backplate, with the support structures providing good ohmic contact between the structures and interior surfaces of the backplate and faceplate.

2. Description of the Related Art

In recent years there have been numerous activities relating to the construction of flat panel displays to replace conventional deflected beam CRT displays. Flat panel displays are lighter and less bulky. In addition to flat CRT displays, other flat panel displays, such as plasma displays, have also been developed.

Flat panel displays include a faceplate, a backplate and connecting walls around the periphery of the faceplate and backplate, forming a vacuum envelope. In some flat panel displays, the envelope is held at vacuum pressure which in the case of CRT displays the vacuum held is about $1\times10^{-7}$ torr or lower. The interior surface of the faceplate is coated with light emissive elements, such as phosphor or phosphor patterns, which define the active region of the display. Cathodes located adjacent to the backplate are excited to release electrons which are accelerated toward the phosphor on the faceplate. The electrons impact the phosphors, and the phosphors emit light seen by the viewer at the exterior of the faceplate.

The vacuum environment produces a force which is exerted on the walls of the flat panel display. Thin faceplate and backplates are not practical without internal supports. In rectangular displays having greater than an approximately 1 inch diagonal, the faceplate and backplate are particularly susceptible to this type of mechanical failure due to their high aspect ratio. The aspect ratio is the distance between support structure in the display divided by the thickness of the faceplate or backplate. The faceplate or backplate of a flat panel display may also fail due to external forces resulting from impacts sustained by the flat panel display.

Spacers have been used to internally support the faceplate and/or the backplate. Previous spacers have been walls or posts located between pixels (phosphor regions that define the smallest individual picture element of the display) in the active region of the display.

The use of spacer walls has been reported in U.S. Pat. No. 4,900,981; U.S. Pat. No. 5,170,100; EPO 464 938A1; EPO 436 997A1 where horizontal walls in the display are used to localize electron beam withdrawals through apertures; EPO 580 244A1 where the wall structures have a very high ohmic layer on only the fine selection side of the walls; and EPO 496 450A1 which discloses wall structures made of a variety of materials.

There is a need for spacers that are able to maintain and hold off a large voltage between the backplate and the faceplate and have good ohmic contacts along the entire length of the spacer where it is in contact with backplate and faceplate interior surfaces.

SUMMARY

An object of the invention is to provide spacers for flat panel displays that maintain good ohmic contact between interior sides of the backplate and the faceplate.

Another object of the invention is to provide spacers for flat panel displays that have face surfaces in contact with the interior sides of the backplate and faceplate that are coated evenly with a conductive layer.

Still a further object of the invention is to provide spacers for flat panel displays that include face surfaces in contact with the interior sides of the backplate and faceplate. The face surfaces are coated with a conductive layer along their entire surface that extends out to peripheries of the face surfaces.

Another object of the invention is to provide spacers in a sealed envelope of a flat panel display with face surfaces coated with a conductive layer, and sidewalls that are in the interior of the display's sealed envelope. The conductive layer does not extend beyond peripheries of the face surfaces to the sidewalls of the spacers.

Yet another object of the invention is to provide spacers in a sealed envelope of a flat panel display with conductive layers on face surfaces, and if the conductive layers extend beyond peripheries of the face surfaces, then they extend uniformly on sidewalls of the spacers.

A further object of the invention is to provide spacers supported by a spacer support member in a sealed envelope of a flat panel display with conductive layers extending uniformly on sidewalls of the spacers in an area between the spacer and the spacer support member.

Still another object of the invention is to provide spacers for flat panel displays with one electrode formed along spacer sidewalls positioned closely adjacent to each face surface of the spacer.

These and other objects of the invention are achieved in a flat panel apparatus that includes a faceplate with a faceplate interior side, and a backplate with a backplate interior side in an opposing relationship to the faceplate interior side. Side walls are positioned between the faceplate and backplate and form an enclosed sealed envelope. One or more spacers is positioned in the envelope. Each spacer has a spacer backplate face, with a periphery, positioned adjacent, e.g., next to, substantially parallel to, or in proximity, to the backplate interior side. Also, each spacer has a spacer faceplate face, with a periphery, positioned adjacent to the faceplate interior side. The spacer has sidewalls. A first conductive layer extends substantially across the entire spacer backplate face to its periphery. Substantially, a second conductive layer extends across the entire spacer faceplate face to the periphery of the spacer backplate face.

Even ohmic contact is desirable. Without even ohmic contact between the spacer backplate face and the backplate interior side, and between the spacer faceplate face and the faceplate interior side, high fields are created where there isn't good ohmic contact, and electrical breakdown can occur.

The first and second conductive layers preferably do not extend beyond the peripheries and onto the sidewalls. If, however, they do extend to the sidewalls, then the conductive layers are applied uniformly on the sidewalls. Preferably, this extension to the sidewalls is not greater than about 0.5%, more preferably no more than about 0.2% of the height of the sidewalls, and in one embodiment it is no more about 4 microns. Spacers can be in the form of walls, posts, and wall segments. The spacers are perpendicular to the faceplate and backplate. The length of a spacer is in a direction parallel to the plane of the faceplate.

In another embodiment of the invention, the flat panel apparatus includes a backplate with a faceplate interior side, a backplate with a backplate interior side, and sidewalls positioned between the faceplate and backplate to form an enclosed sealed envelope. At least one well is formed in the faceplate interior side or the backplate interior side with a height of $h_1$. A spacer, with first and second opposing sidewalls, has a spacer backplate face with a periphery, and a spacer faceplate face with a periphery. The spacer is positioned in the well. A first conductive layer on the spacer sidewalls extends substantially uniformly across the entire spacer sidewalls in the well. The first conductive layer has a height which does not exceed $h_1$.

The well can be formed in the faceplate interior side, the backplate interior side, or two wells can be formed on each interior side. The spacer faceplate face and backplate face are then each positioned in a well. A second conductive layer can be applied and extend substantially across the entire spacer faceplate face to its periphery. A third conductive layer can be applied and extend substantially across the entire spacer backplate face to its periphery.

In yet another embodiment of the invention the conductive layers on the spacer faceplate face and the spacer backplate face are eliminated. One electrode extends along the spacer sidewalls and is positioned sufficiently close to the periphery of the spacer faceplate face to produce a substantially even ohmic contact between the faceplate face, and the faceplate interior surface. Another electrode is positioned close enough to the spacer backplate face to achieve the same even ohmic contact. For purposes of this disclosure, even ohmic contact for an electrode positioned adjacent to a resistor is defined as, at a distance of about 1 μm from the electrode the potential in the resistor is within 20 volts of the voltage at the electrode.

DESCRIPTION OF THE DRAWINGS

FIG. 3(*b*) is a perspective view of a post spacer of the invention.

DETAILED DESCRIPTION OF THE PREFERRED EMBODIMENTS

In the following description, embodiments of the invention are described with respect to a flat cathode ray tube (CRT) display. It will be appreciated that the invention is applicable to other flat panel displays, including but not limited to plasma displays, vacuum fluorescent displays, and the like.

A flat panel display is a display in which a faceplate and backplate are substantially parallel, and the thickness of the display is small compared to the thickness of a conventional deflected-beam CRT display, the thickness of the display being measured in a direction substantially perpendicular to the faceplate and backplate. Often the thickness of a flat panel display is substantially less than about 2.0 inches, and in one embodiment it is about 0.15 inches.

Figure 1:
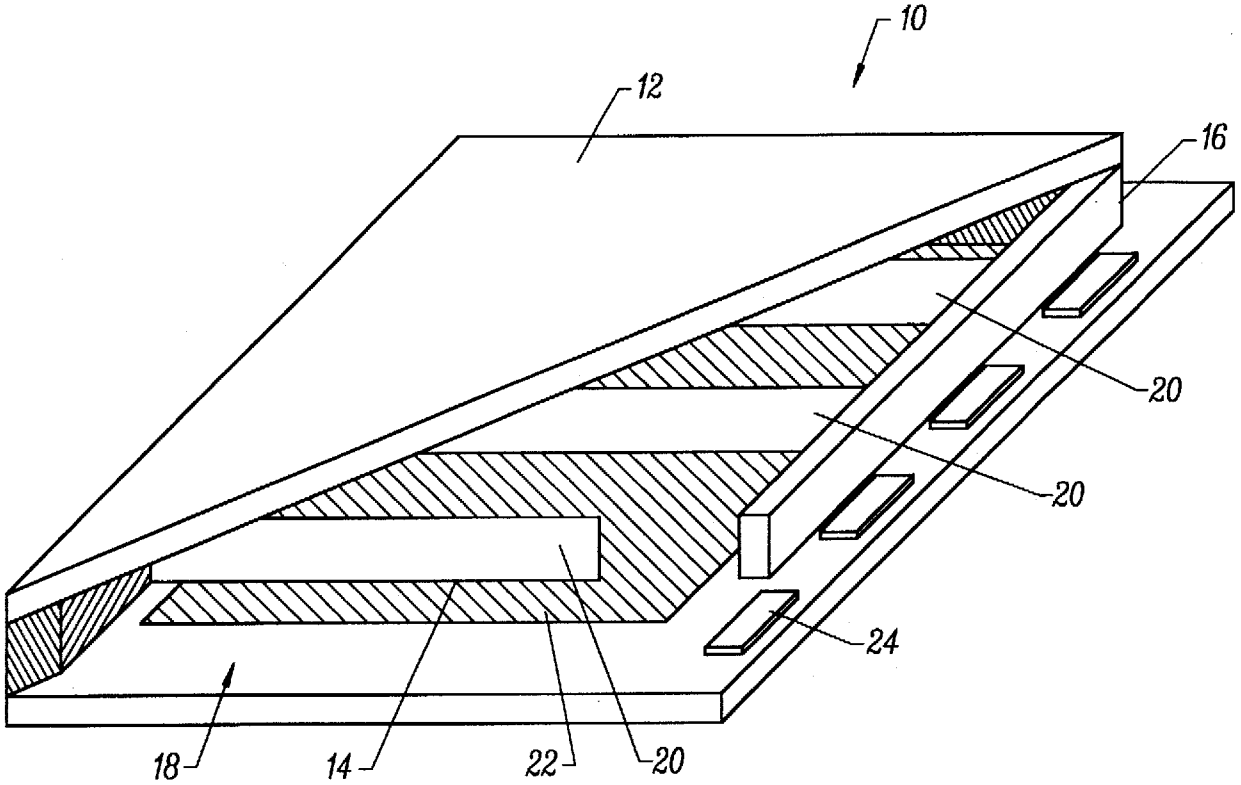
FIG. 1 is a perspective cutaway view of a flat panel display including a field emission cathode according to one embodiment of the invention.

Referring now to FIG. 1, a flat panel display 10 includes a faceplate 12, backplate 14 and side walls 16, which together form a sealed envelope 18 that is held at vacuum pressure, e.g., approximately $1\times10^{-7}$ torr or less. One or more spacers 20 support faceplate 12 against backplate 14. Spacers can be walls, posts, wall segments and the like.

Spacers 20 can extend from one side to the other of sealed envelope 18. However, it will be appreciated that spacers 20 need not extend across sealed envelope. Spacers 20 are formed to provide support and do not adversely affect electron flow to faceplate 12.

Spacers 20 must have a sufficiently small thickness so that they provide minimal interference with the operation of cathode structures or phosphors. Spacers 20 are preferably made of a thin material that is compatible with use in a vacuum environment. Spacers 20 are made of a material with a coefficient of thermal expansion that closely matches the coefficients of thermal expansion of faceplate 12 and backplate 14.

In one embodiment of the invention, spacers 20 are made of a ceramic or glass-ceramic material. They can also be formed from ceramic tape. Other suitable materials include but are not limited to, ceramic reinforced glass, devitrified glass, amorphous glass in a flexible matrix, bulk resistive materials such as a titanium aluminum chromium oxide, high-temperature vacuum-compatible polyimides or insulators such as silicon nitride.

In one embodiment a field emitter cathode 22 can be formed on a surface of backplate 14 within envelope 18. Row and column electrodes control the emission of electrons from a cathodic emission element. The electrons are accelerated toward a phosphor-coated interior surface of faceplate 12, the active region. Integrated circuit chips 24 include driving circuitry for controlling the voltage of the row and column electrodes so that the flow of electrons to faceplate 12 is regulated. Electrically conductive traces can be used to electrically connect circuitry on chips 24 to the row and column electrodes.

Figure 2:
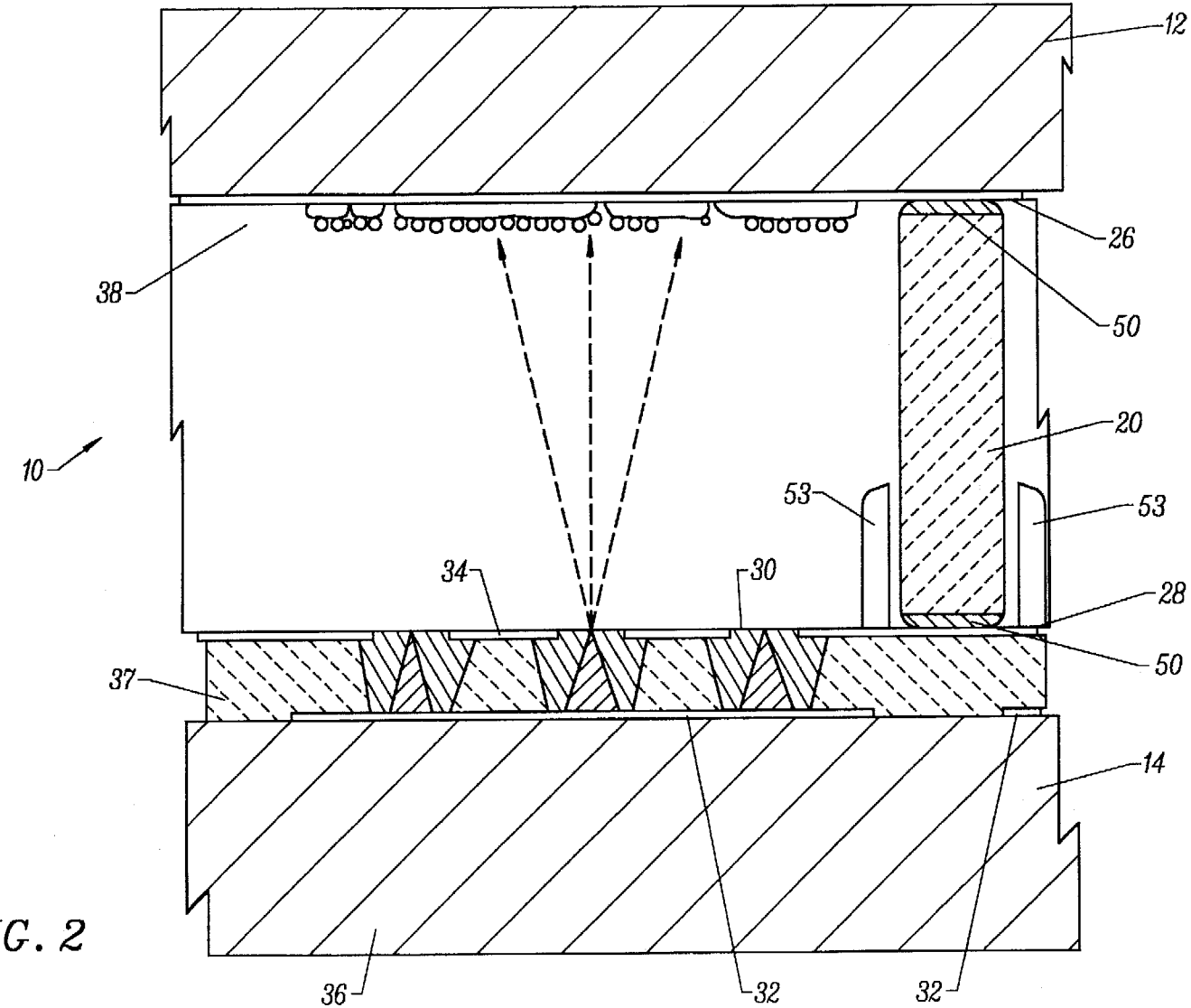
FIG. 2 is a cross-sectional view of a portion of a flat panel display according to an embodiment of the invention including a field emitter cathode with a spacer wall, post or wall segment.

Referring now to FIG. 2, a field emitter display (FED) structure 10 is illustrated. Display 10 includes a faceplate interior side 26, and a backplate interior side 28. Spacer 20 adds structural support between interior side 26 and interior side 28. It will be appreciated that interior sides 26 and 28 can be of different geometric forms, and although they are shown in FIG. 2 as being substantially flat even surfaces, they can include a number of different surfaces including but not limited to backplates, electrodes, ridges and other structures. In any event, spacer 20 provides needed support for faceplate 12 and backplate 14. In FIG. 2, emitters 30 are formed on row electrodes 32. As shown in FIG. 2, emitters 30 are cones, but it will be appreciated that other suitable emitter structures, such as filaments, are suitable, as well known to those skilled in the art. Column electrodes 34 are formed on an insulator 37. Phosphor 38 is formed on faceplate interior side 26.

Figure 3B:
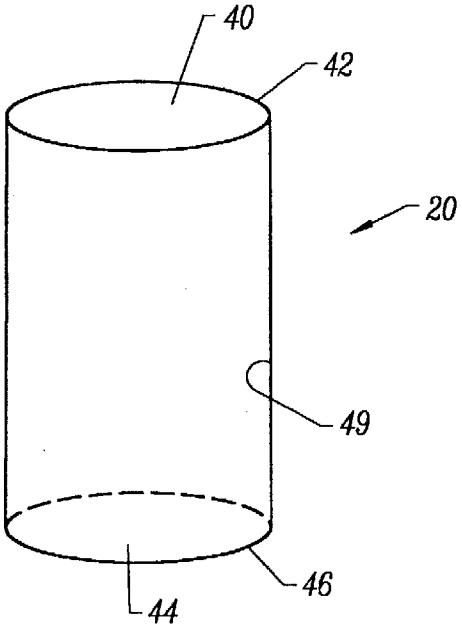
FIG. 3(*a*) is a perspective view of a generally rectangular spacer wall of the invention.
Figure 3A:
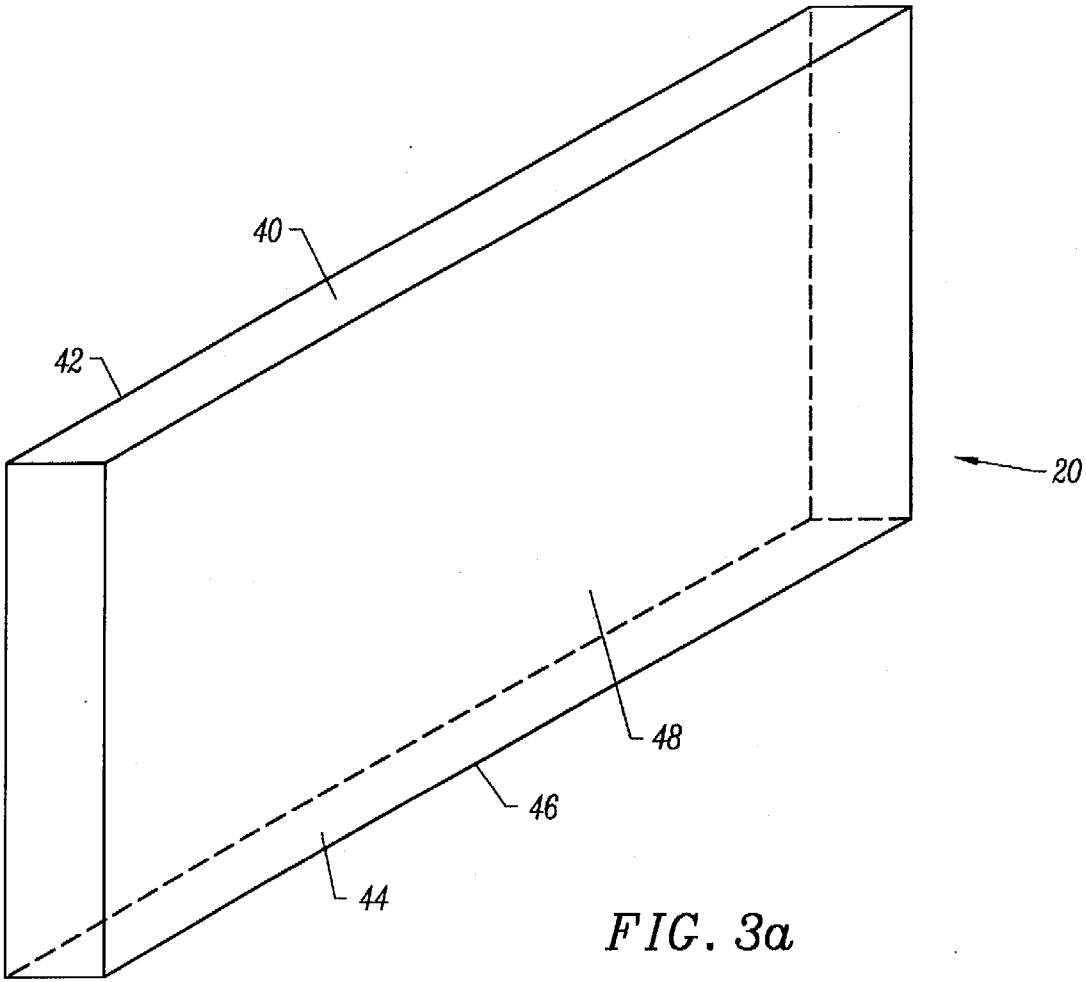

FIG. 3(*a*) illustrates a wall spacer 20 of the invention, and FIG. 3(*b*) illustrates a post spacer 20. Each spacer 20 includes a spacer faceplate face 40 with a periphery 42, and a spacer backplate face 44 with a periphery 46. Spacer wall of FIG. 3(*a*) includes first and second sidewalls 48 that are positioned so that they face and interact with sealed envelope 18. Post spacer 20 of FIG. 3(*b*) includes a cylindrical sidewall 49.

Spacers 20 can be made of a bulk resistive material. If spacers 20 are formed of an insulator, then their sidewalls can be coated with a resistive coating, or they can be surface doped. The resistive coating minimizes charge build-up on spacer 20 that can distort the flow of electrons. There is a need to bleed charge away from spacer 20, caused by stray electrons from the electron source striking spacer 20, and yet maintain the high potential difference across spacer 20 without running a high current through it. The coating can be formed on a spacer wall by methods well known in the art, including but not limited to sputtering, evaporation, chemical vapor deposition, thermal or plasma-enhanced printing, roll-on, spraying or dipping. It is desirable to form the coating with a sheet resistance uniformity of better than ±2%. This is achieved by controlling the coating within a specified tolerance.

Referring once again to FIG. 2, in one embodiment of the invention a high potential, V, of 4,000 volts or higher is applied between faceplate interior side 26 and backplate interior side 28. This high potential provides for a higher efficiency of display 10 in comparison to a low energy phosphor system such as one with a potential of 300 V, and reduces the aging of phosphors 38.

Spacer 20 is a resistor, or an insulator coated with a resistive coating in order to reduce charge build up. Each face 40 and 44 can be coated with a conductive layer 50, in effect metallized if the conductive layer is a metal, where the face is adjacent interior sides 26 and 28, and the metal of faces 40 and 44 is in ohmic contact with interior side 26 or 28 respectively. Without conductive layer 50 on spacer backplate face 44, current flows down and begins to charge spacer 20 towards the potential maintained at faceplate 26, 4,000 volts or higher. Without conductive layer 50 on spacer faceplate face 40, current flows down. If conductive layer 50 is on neither face 40 or 44 then spacer 20 charges towards the potential of the nearest good contact, resulting in non-uniformity. If there isn't good ohmic contact across faces 40 and 44, then high fields are created where there isn't good ohmic contact, and electrical breakdown can occur. As spacer 20 becomes charged electrons are deflected away from target phosphor dots on faceplate 12, and the output of display 10 is degraded. This problem is resolved by providing good ohmic contact to a sufficiently conducting bleed-off path along the entire length of spacer 20, along faces 40 and 44 where they are in contact with faceplate interior side 26 and backplate interior side 28.

In one embodiment of the invention, conductive layer 50 is a metal, including but not limited to aluminum, nickel and the like. It will be appreciated that other conducting materials are suitable. The actual interfaces between faces 40 and 44, and their respective faceplates and backplates, can be of a number of different configurations, depending on the surface structure of faceplate interior side 26 and backplate interior side 28. However, in any event, conductive layer 50 is spread substantially across the entire surface of faces 40 and 44 and extends to the periphery of each face, but does not extend appreciably beyond the periphery.

Figure 4:
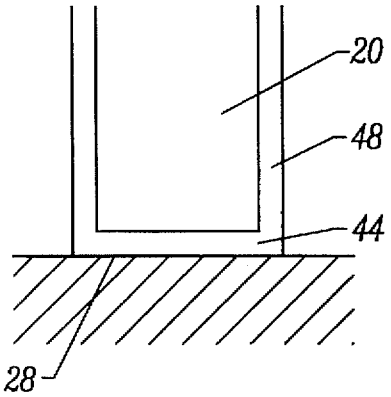
FIG. 4 is a cross-sectional view of a spacer wall with a spacer backplate face positioned adjacent to an interior side of a backplate.
Figure 5:
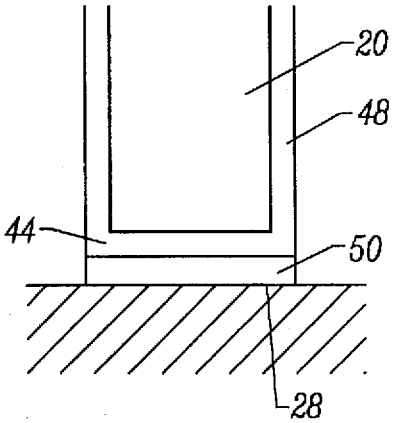
FIG. 5 is a cross-sectional view of a spacer wall and a backplate interior side. A conductive layer is formed on a spacer backplate face.

FIG. 4 illustrates spacer 20 without conductive layer 50. In FIG. 5 the entire surface of face 44 is covered with a conductive layer 50 so that there is good and even ohmic contact between spacer 20 and interior 28. There is substantially no gap in covering face 44 with conductive layer 50.

Figure 6:
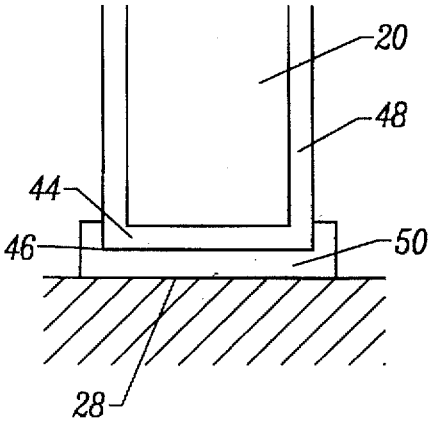
FIG. 6 is a cross-sectional view of a conductive layer formed on a spacer backplate face that extends slightly along the sidewalls of the spacer.

As illustrated in FIG. 6, conductive layer 50 extends as little as possible beyond peripheries 42 and 46 and down or up sidewalls 48. Preferably, conductive layer 50 extends no more than about 0.5%, more preferably no more than about 0.2% of the height of the sidewalls 48. In one embodiment, the extension is 4 microns or less. However, conductive layer 50 can extend around and along sidewalls 48 a slight distance if it extends uniformly along sidewalls 48.

Figure 7:
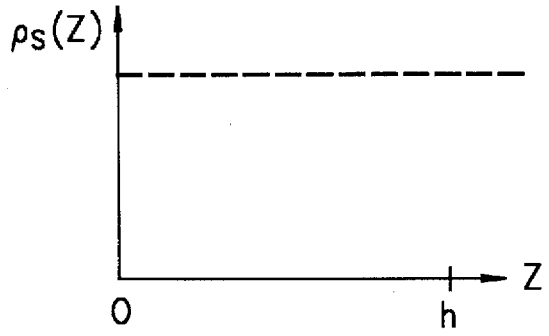
FIG. 7 is a graph of sheet resistance $\rho_s$ verses height "h" of the spacer wall.
Figure 8:
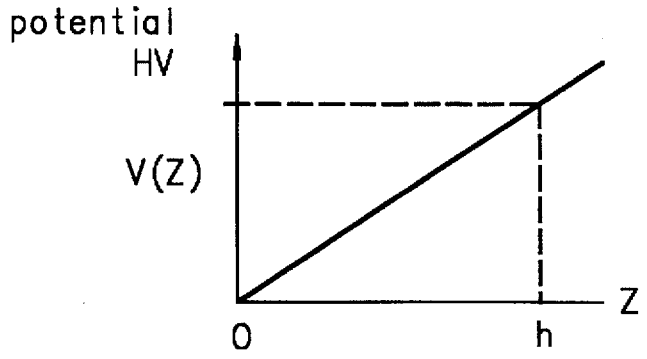
FIG. 8 is a graph plotting potential verses height h of the spacer wall.

In FIG. 7, there is no conductive layer 50 along sidewalls 48, and the sheet resistance $\rho_s$ remains uniform along the entire height h of spacer 20. If conductive layer 50 is not found on sidewalls 48 in sealed envelope 18, the potential, HV, remains linear along the entire height h of spacer 20, in FIG. 8.

This potential deviates from the ideal situation if, (i) conductive layer 50 is not spread across the entire surface of face 40 or 44 to the peripheries 42 and 46 respectively, or (ii) conductive layer 50 extends beyond peripheries 42 or 46 and forms non-evenly on a sidewall 48 or 49. It also deviates if conductive layer 50 is not applied uniformly to sidewalls 48 with spacer 20 positioned between focusing structures 53 (as illustrated in FIG. 2) or positioned in a well 51 of spacer support member 53 (FIG. 2).

Figure 9:
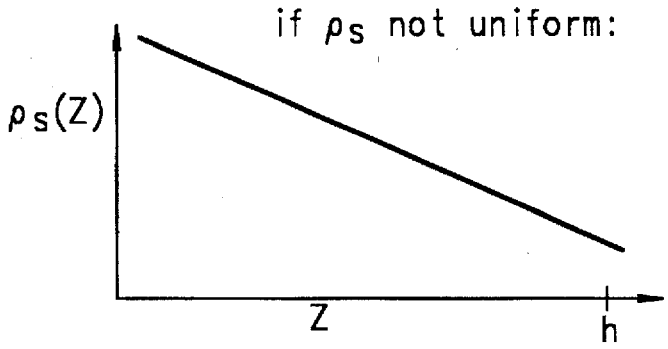
FIG. 9 is a graph plotting height h of a spacer with a varying sheet resistance $\rho_s$ of the spacer.
Figure 10:
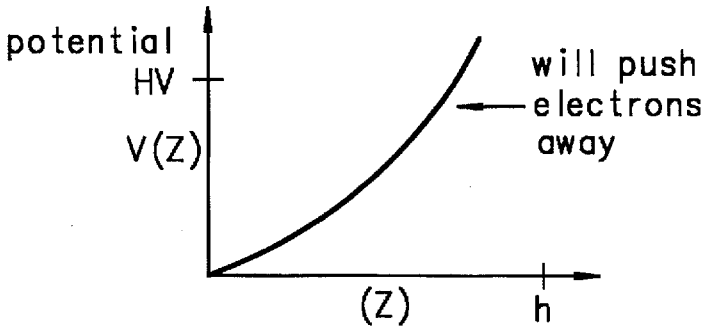
FIG. 10 is a graph plotting potential as a function of spacer height h with a spacer of varying sheet resistance $\rho_s$.

If the conductivity of spacer 20 varies along sidewalls 48 then sheet resistance $\rho_s$ is not uniform. This is illustrated in FIG. 9. A potential drop occurs along the height h of spacer 20 and is shown as a curve in FIG. 10. Electrons are either pushed away from spacer 20, as in FIG. 10, or pulled into spacer 20, depending on the evenness of application of conductive layer 50 and whether or not there are gaps in its application to faces 40 or 44.

Figure 11:
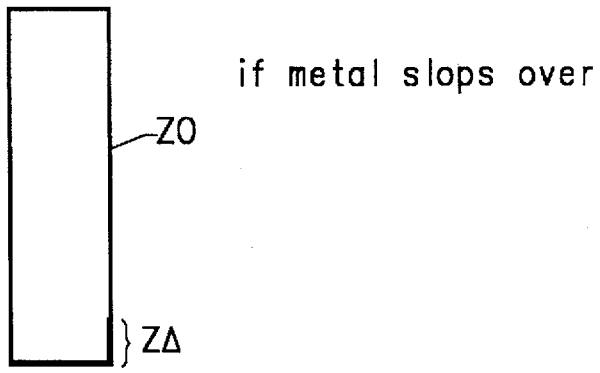
FIG. 11 is a cross-sectional view of a spacer with a conductive layer that extends partially along a distance $Z_o$ of a sidewall that is in the sealed envelope.
Figure 12:
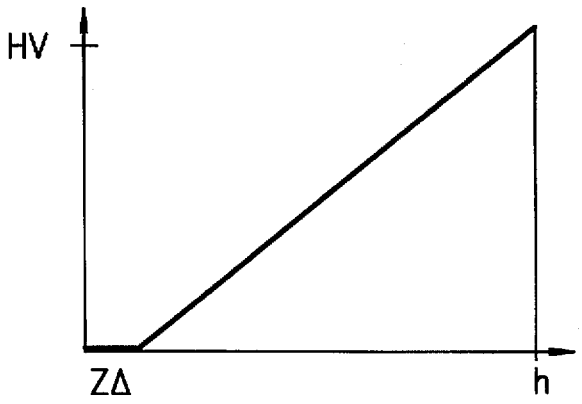
FIG. 12 is a graph plotting the potential of the spacer of FIG. 11 as a function of height h.

In FIG. 11, conductive layer 50 extends a distance $Z_0$ along sidewall 48. FIG. 12 illustrates that in this example, spacer 20 is at zero volts for a distance $Z_0$. Once past the point where $Z_0$ ends, there is a linear increase in potential. It is desirable to only cover faces 40 and 44 with conductive layer 50. The layers should cover the entire faces, but not extend beyond peripheries 42 or 44. Conductive layer 50 applied to face 40 need not be of the same "thickness" as that applied to face 44. It is only necessary that all of faces 40 and 44 be covered in order to insure a good, even ohmic contact with faceplate interior side 26 and backplate interior side 28.

Figure 13:
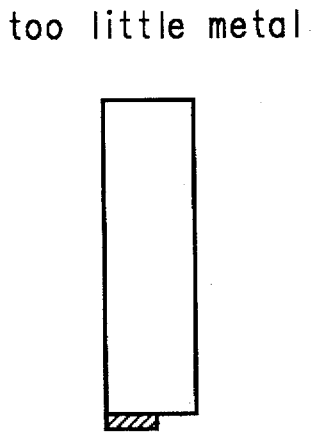
FIG. 13 is a cross-sectional view of a spacer with a conductive layer on a face that does not extend across the entire face.
Figure 14:
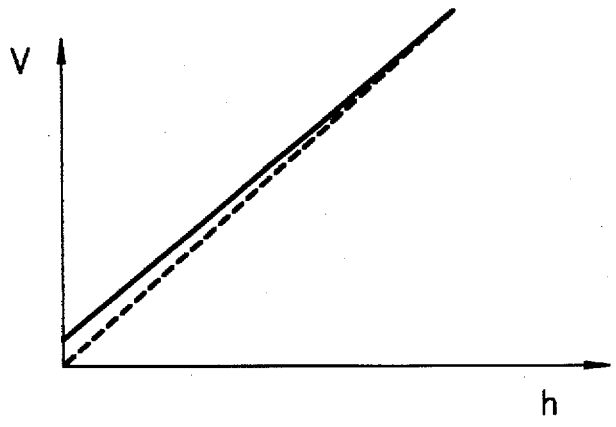
FIG. 14 is a graph of potential verses height h of the spacer of FIG. 13.

If too little of conductive layer 50 is applied to a face, e.g., if the conductive layer is not evenly applied across a face as in FIG. 13, then there is a positive voltage at height zero (FIG. 14).

Figure 15:
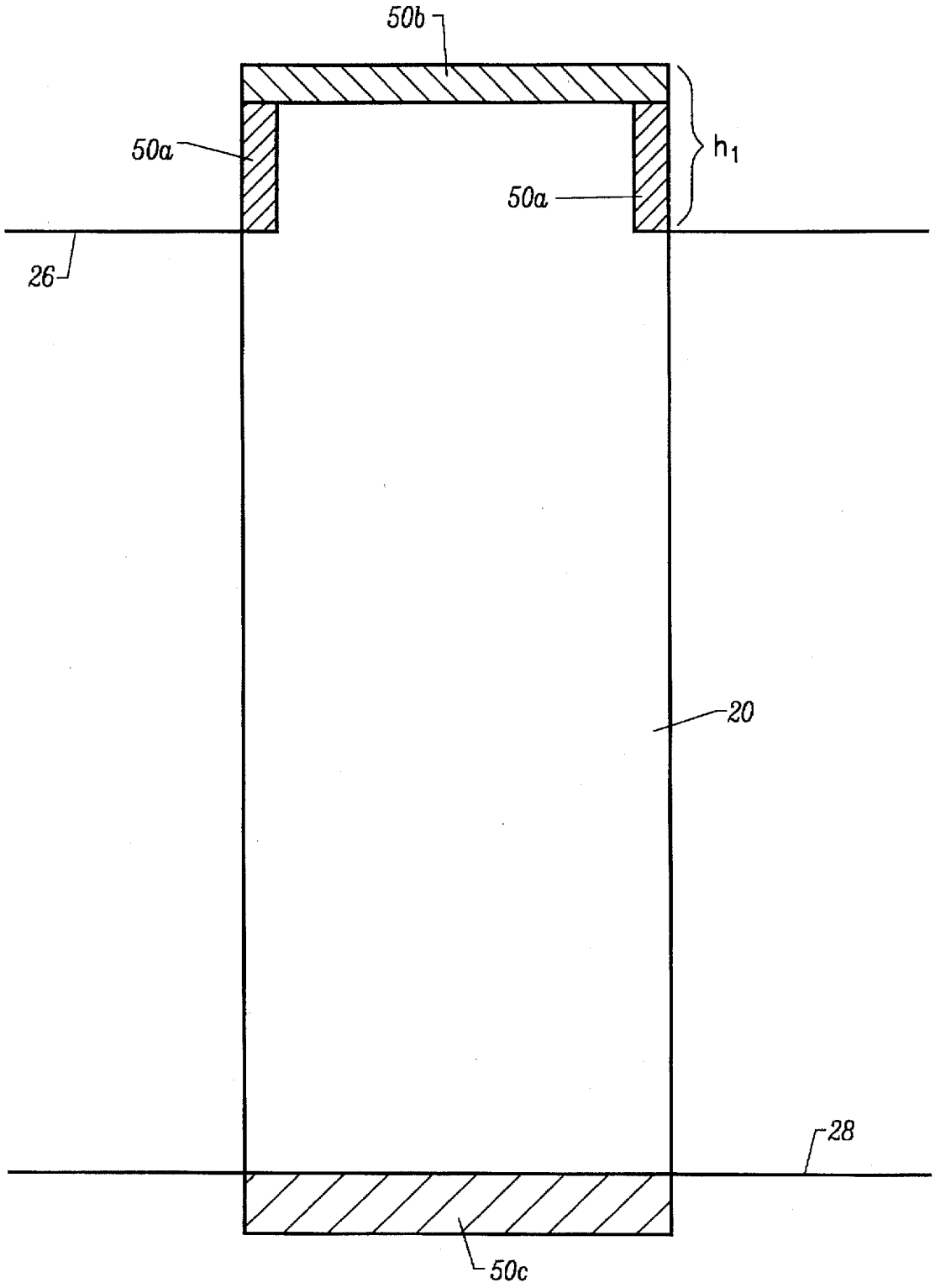
FIG. 15 is a cross-sectional view of a spacer that is positioned in a well formed of an interior side of the backplate or faceplate.

In another embodiment of the invention, illustrated in FIG. 15, a well 51 is formed in one or both of interior sides 26 or 28. Well 51 has a height of $h_1$ that is the distance between the bottom of the well to either one of interior sides 26 or 28. If well 51 is formed in both interior sides 26 and 28, then its height need not be the same for both wells. A first conductive layer 50*a* is on spacer sidewalls 48 which extends substantially uniformly across the entire height of spacer sidewalls 48 that is in well 51. However, the first conductive layer does not exceed $h_1$. A second conductive layer 50*b* extends can be included. It extends substantially across the entire spacer faceplate face to its periphery. If spacer wall 20 is also placed in a second well 51 at the interior side 28, then a third conductive layer 50*e* can be included that extends substantially across the entire spacer backplate face to its periphery.

Although it is preferred that second and third conductive layers extend across the entire surface of faces 40 and 44 to their peripheries 42 and 46 respectively, it is possible that the conductive layer not extend to the periphery so long as it remains a uniform distance from the periphery across the entire surface of face 40 or 44. This can be achieved by masking off an even area around the entire periphery 42 or 46. If it is not even, then the potential at any height h of spacer 20 is not constant along the longitudinal length of spacer 20.

Figure 16:
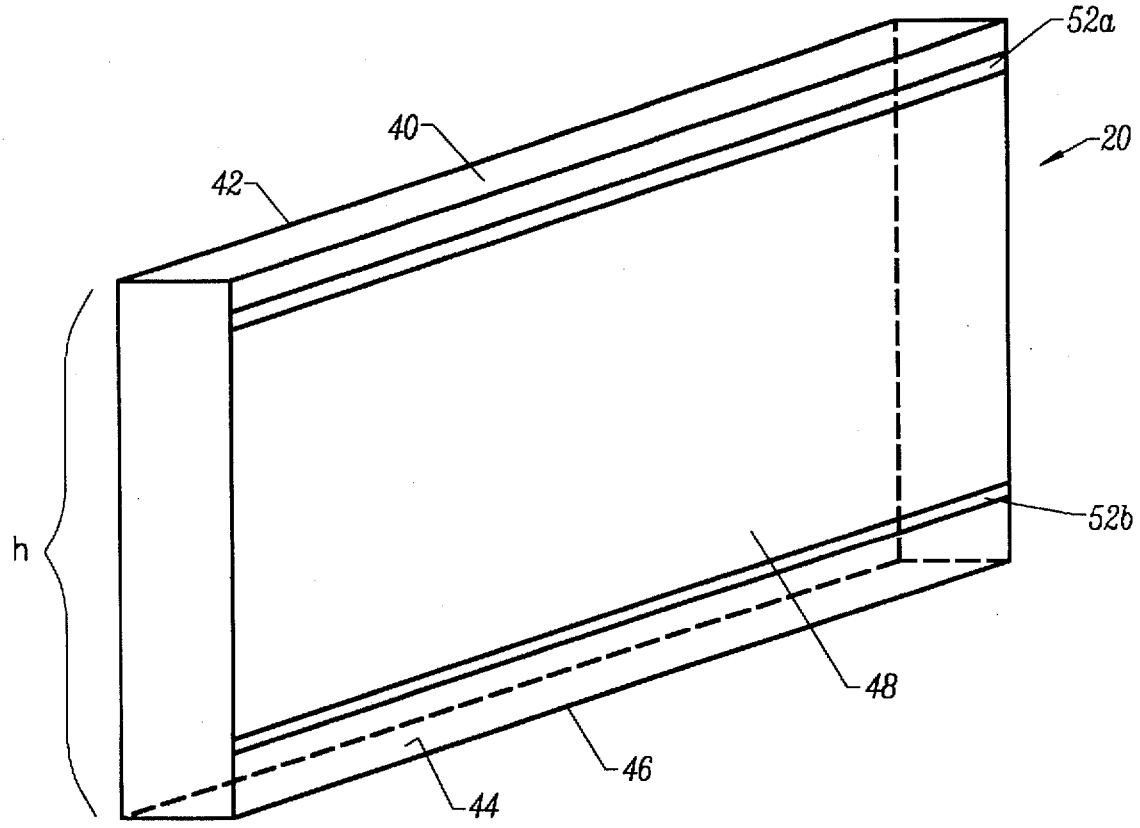
FIG. 16 is a perspective view of a rectangular spacer wall that includes electrodes formed on sidewalls.

As illustrated in FIG. 16, in place of conductive layers 50 (metallization on the end of spacers 20), one or more conductive electrodes 52 are formed on sidewalls 48, with an electrode in close proximity to faces 40 and 44. Only electrodes 52(*a*) and 52(*b*), which are positioned closest to faces 40 and 44 are necessary to take the place of conductive layers 50. In the case where spacer 20 is not positioned in spacer support member 53, electrode 52(*a*) should be positioned no more than about 5% of h from periphery 42, and electrode 52(*b*) should be positioned no more than about 2% of h from periphery 46. This eliminates the need for conductive layers 50 at faces 40 and 44.

In one embodiment of the invention spacers 20 are ceramic. A resistive coating is applied that has a secondary emission ratio $\delta$ less than 4 and a sheet resistance $\rho_s$ between $10^9$ and $10^{14}$ Ω/□. In an additional embodiment, the material used for resistive coating 26 has the above sheet resistance $\rho_s$, and a secondary emission ratio $\delta$ less than 2. Resistive coating in this embodiment is, for instance, chromium oxide, copper oxide, carbon, titanium oxide, vanadium oxide or a mixture of these materials, and has a thickness between 0.05 and 20 μm. The internal surfaces of faceplate 12 and backplate 14 are about 0.004 to 0.2 inches (alignment about 0.1 to 5.0 mm) apart. Faceplate 12 is glass and has a thickness of about 0.040 inches (1.0 mm). Backplate 14 is glass, ceramic, or silicon having a thickness of 0.040 inches (1.0 mm). Each spacer 20 has a thickness of about 50 to 75 μm. The center-to-center spacing of spacers 20 is 8 to 25 mm. Spacer 20 can have a sheet resistance of about $10^{11}$ to $10^{13}$ Ω/□ when it is a wall or post.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A flat panel apparatus, comprising:

a faceplate including a faceplate interior side;

a backplate including a backplate interior side in an opposing relationship to the faceplate interior side;

envelope sidewalls positioned between the faceplate and backplate to form an enclosed sealed envelope between the envelope sidewalls, backplate interior side and the faceplate interior side;

a resistive spacer, or an insulating spacer with a resistive coating on an exterior of the insulating spacer, positioned in the envelope including a spacer backplate face with a periphery positioned adjacent to the backplate interior side, and a spacer faceplate face with a periphery positioned adjacent to the faceplate interior face;

a first conductive layer that extends across substantially the entire spacer backplate face to the backplate face periphery; and a second conductive layer that extends across substantially the entire spacer faceplate face to the faceplate face periphery.

2. The flat panel apparatus of claim 1, wherein the first and second conductive layers are made of metal.

3. The flat panel apparatus of claim 1, wherein the first and second conductive layers are made of the same material.

4. The flat panel apparatus of claim 1, wherein the spacer has at least one sidewall and the first and second conductive layers extend beyond the peripheries of the faces a substantially even distance along the at least one sidewall.

5. The flat panel apparatus of claim 4, wherein the first and second conductive layers do not extend more than 0.5% of a height h of the at least one sidewall.

6. The flat panel apparatus of claim 1, wherein the spacer is a wall.

7. The flat panel apparatus of claim 6, wherein the wall has a sheet resistance of about $10^{11}$ to $10^{13}$ Ω/□.

8. The flat panel apparatus of claim 1, wherein the spacer is a post.

9. The flat panel apparatus of claim 8, wherein the post has a sheet resistance of about $10^{11}$ to $10^{13}$Ω/□.

10. The flat panel apparatus of claim 1, further comprising:

a focusing structure positioned in the envelope, wherein the spacer has at least one sidewall, the focusing structure is positioned adjacent to the at least one sidewall and the spacer includes a conductive layer on the at least one sidewall adjacent to the at least one focusing structure.

11. A flat panel apparatus, comprising:

a faceplate including a faceplate interior side;

a backplate including a backplate interior side in an opposing relationship to the faceplate interior side;

envelope sidewalls positioned between the faceplate and the backplate to form an enclosed sealed envelope between the envelope sidewalls, backplate interior side and the faceplate interior side;

at least one spacer, the at least one spacer being an insulating spacer with a resistive coating on an exterior of the insulating spacer or a resistive spacer, positioned in the envelope including a spacer backplate face with a periphery positioned adjacent to the backplate interior side, and a spacer faceplate face with a periphery positioned adjacent to the faceplate interior face, the spacer further including at least one sidewall; and a first electrode on the spacer which extends along the at least one sidewall and positioned sufficiently close to the periphery of the spacer faceplate face to produce a substantially even ohmic contact between the spacer faceplate face and the faceplate interior surface.

12. The flat panel apparatus of claim 11, further comprising:

a second electrode positioned sufficiently close to the periphery of the spacer backplate face to produce a substantially even ohmic contact between the backplate face and backplate interior surface.

13. The flat panel apparatus of claim 11, further comprising:

a first conductive layer that extends substantially across the entire spacer backplate face to the spacer backplate face periphery.

14. The flat panel apparatus of claim 11, wherein the at least one spacer has a height of h, and the first electrode is positioned close to the periphery of the spacer faceplate face at a distance that does not exceed about 5% of h away from the periphery of the spacer faceplate face.

15. The flat panel apparatus of claim 12, wherein the at least one spacer has a height of h, and the second electrode is positioned close to the periphery of the spacer backplate face at a distance that does not exceed about 2% of h away from the periphery of the spacer backplate face.

16. The flat panel apparatus of claim 11, wherein the at least one spacer is a wall.

17. The flat panel apparatus of claim 16, wherein the wall has a substantially rectangular geometry.

18. The flat panel apparatus of claim 16, wherein the at least one spacer has a sheet resistance of about $10^{11}$ to $10^{13}$ Ω/□.

19. The flat panel apparatus of claim 11, wherein the at least one spacer is a post.

20. The flat panel apparatus of claim 19, wherein the at least one spacer has a sheet resistance of about $10^{11}$ to $10^{13}$ Ω/□.

21. The flat panel apparatus of claim 11, wherein the at least one spacer is a plurality of spacers.

22. The flat panel apparatus of claim 21, wherein the plurality of spacers includes a plurality of spacer walls and spacer posts.

23. The flat panel apparatus of claim 21, wherein the plurality of spacers comprises a plurality of spacer wall segments.

24. The flat panel apparatus of claim 11, further comprising:

a focusing structure positioned in the envelope, wherein the at least one spacer has at least one sidewall, the focusing structure is positioned adjacent to the at least one sidewall and the spacer includes a conductive layer on the at least one sidewall adjacent to the at least one focusing structure.

25. A flat panel apparatus, comprising:

a faceplate including a faceplate interior side;

a backplate including a backplate interior side in an opposing relationship to the faceplate interior side;

envelope sidewalls positioned between the faceplate and backplate to form an enclosed sealed envelope between the envelope sidewalls, backplate interior side and the faceplate interior side;

at least one well formed in the faceplate interior side or the backplate interior side with a height of $h_1$;

a spacer including at least one spacer sidewall, a spacer backplate face with a periphery, and a spacer faceplate face with a periphery, the spacer being positioned in the well; and a first conductive layer on the at least one spacer sidewall that extends substantially uniformly across the entire at least one spacer sidewall in the well with the first conductive layer height not exceeding $h_1$.

26. The flat panel apparatus of claim 25, wherein the spacer faceplate face is positioned in a first well at the faceplate interior side.

27. The flat panel apparatus of claim 26, further comprising:

a second conductive layer that extends substantially across the entire spacer faceplate face to its periphery.

28. The flat panel apparatus of claim 25, wherein the spacer backplate face is positioned in a first well at the backplate interior side.

29. The flat panel apparatus of claim 28, further comprising:

a third conductive layer that extends substantially across the entire spacer backplate face to its periphery.

30. The flat panel apparatus of claim 25, wherein the spacer faceplate face is positioned in a first well at the faceplate interior side, and the spacer backplate face is positioned in a second well at the backplate interior side, and the heights of the first well and the second well are different.

31. The flat panel apparatus of claim 30, further comprising:

a second conductive layer that extends substantially across the entire spacer faceplate face to its periphery; and a third conductive layer that extends substantially across the entire spacer backplate face to its periphery.

32. The flat panel apparatus of claim 25, wherein the spacer faceplate face is positioned in a first well at the faceplate interior side, and the spacer backplate face is positioned in a second well at the backplate interior side,. and the heights of the first well and the second well are substantially the same.

33. The flat panel apparatus of claim 32, further comprising:

a second conductive layer that extends substantially across the entire spacer faceplate face to its periphery; and a third conductive layer that extends substantially across the entire spacer backplate face to its periphery.

* * * * *